United States Patent [19]

Nieuwkamp et al.

[11] 4,426,041

[45] Jan. 17, 1984

[54] SOLID-CONE JET NOZZLE FOR SPRAYING LIQUIDS

[75] Inventors: Wolfgang Nieuwkamp, Kappishäusern; Dieter Kröger, St. Johann/Bleichstetten; Werner Raissle, Metzingen, all of Fed. Rep. of Germany

[73] Assignee: Lechler GmbH & Co. KG, Baden-Wuerttemberg, Fed. Rep. of Germany

[21] Appl. No.: 277,138

[22] Filed: Jun. 25, 1981

[30] Foreign Application Priority Data

Jun. 28, 1980 [DE] Fed. Rep. of Germany ..... 3024472

[51] Int. Cl.[3] ..... B05B 1/34

[52] U.S. Cl. ..... 239/468; 239/469

[58] Field of Search ..... 239/461, 463, 468, 469, 239/471, 491, 590, 590.5

[56] References Cited

U.S. PATENT DOCUMENTS

| | | | |
|---|---|---|---|
| 1,293,108 | 2/1919 | Judson | 239/468 |
| 1,961,408 | 6/1934 | Wahlin | 239/468 |
| 2,358,177 | 9/1944 | Madison | 239/469 |

FOREIGN PATENT DOCUMENTS

| | | | |
|---|---|---|---|
| 2604264 | 2/1977 | Fed. Rep. of Germany . | |
| 585884 | 12/1977 | U.S.S.R. | 239/468 |
| 589030 | 1/1978 | U.S.S.R. | 239/468 |
| 638383 | 12/1978 | U.S.S.R. | 239/468 |

*Primary Examiner*—Andres Kashnikow

*Attorney, Agent, or Firm*—Shlesinger, Arkwright, Garvey & Fado

[57] ABSTRACT

A solid-cone jet nozzle for spraying liquids has a cylindrical turbulence chamber, a liquid feed bore that tangentially enters the chamber, a flaring discharge opening that forms an axial extension of the chamber, and recesses and elevations made in the bottom of the chamber. The liquid exits the discharge opening in a direction which is perpendicular to the liquid feed bore. The recesses and elevations control the liquid flow.

16 Claims, 6 Drawing Figures

SOLID-CONE JET NOZZLE FOR SPRAYING LIQUIDS

The invention relates to a solid-cone jet nozzle for spraying liquids, comprising a cylindrical turbulence chamber, a liquid feed means tangentially entering said chamber and a nozzle discharge forming the axial extension of the turbulence chamber, where the flow exit direction is perpendicular to the liquid feed means, and recesses and elevations to control the liquid flow being fashioned in the bottom of the turbulence chamber opposite the nozzle discharge.

It is generally known to arrange spin means insets in the housing of nozzles in order to set into rotation the liquid before it exits from the nozzle at the nozzle-discharge. Spin-means insets for solid-cone jet nozzles, as a rule besides the rim bores also comprise a center bore. In this manner the liquid flow within the nozzle housing is divided into axial and radial flow components. Now when the inlet pressure are substantial, there will be an appreciable enhancement in the effect from the axial flow component. This reinforcement causes a reduction in the angle of the jet. Moreover the inside of the nozzle housing is much reduced, i.e. narrowed on account of the spin-means inset, so that the inside of the nozzle housing may clog. Lastly a spin-means inset represents an additional precision component requiring rigorous workmanship, determining corresponding costs in manufacture and assembly.

The German Offenlegungsschrift No. 26 04 264 already discloses a nozzle wherein rotation of the liquid is achieved within the nozzle housing without a separate spin-means inset and rather only by a tangential liquid feed means. This is a nozzle of the so-called species, where the direction of the liquid feed means is at a right angle to the direction of the liquid discharge means. Ordinarily however the design steps of an L-nozzle do not result in a solid-cone jet, rather a hollow-cone jet, which is unsuited for some applications requiring as uniform as possible and areal apraying (for instance when cooling rolled steel). Now the attempts already have been made to generate an approximately conical pattern of the discharged liquid jet by making nozzle mouth means serrated or tooth-shaped but success so far has only been imperfect, as the trade-off that must be incurred is a very uneven liquid distribution across the cross-section of the cone. The German Offenlegungsschrift No. 26 04 264 proposes an improved solution, whereby the turbulence chamber within the nozzle housing comprises a bottom rising or elevating in the downstream direction and where the discharge channel is provided with a side wall which narrows at the center and gradually opens towards the final aperture to facilitate a solid conical or nearly-conical spray or atomizing pattern.

A solid-cone jet nozzle of the initially mentioned kind moreover has been described in the USSR Pat. No. 58 90 30. As regards this known L-nozzle, a cross-slotted recess is made in the bottom of the turbulence chamber for the purpose of achieving a solid-cone jet. It is the object of the present invention is to obtain an improved flow control for a nozzle of the initially cited kind by a special design of the turbulence chamber bottom. This problem is solved by the invention essentially in that the turbulence chamber bottom comprises several individual recesses and/or elevations.

The invention advantageously achieves large clear cross-sections within the nozzle housing, whereby the risk of clogging is at least almost averted. The clear cross-sections are determined solely by the sizes of the supply and discharge bores. The steps of the invention furthermore makes it possible to obtain a constant jet angle at various pressures because no splitting of the flow within the nozzle into an external radial component and a center axial component takes place in the design of the invention.

The individual elevations and recesses of the invention are made in a simple manner for instance by injection molding (when the turbulence chamber bottom is a plastic) or by multiple milling in a continuous process (when the turbulence chamber is a metal part), and moreover offer the advantage over the known state of the art that, should there ever be clogging of the clear spaces in the turbulence chamber bottom, automatic self-unclogging should take place as the flow continues. Besides there will be no constriction of the flow cross-section in the nozzle housing due to any clogging as long as the clogging means do not exceed the height of the elevations on the turbulence chamber bottom. This means, even in the case of some clogging of the clear spaces in the turbulence chamber bottom, that the spraying process never fails. This fact is decisive to the maintaining of operational conditions and to prevent large malfunctions in processes and facilities where the nozzles of the invention are applicable.

In principle it is conceivable to distribute in arbitrary manner the individual recesses and/or elevations on the bottom of the turbulence chamber. The invention however prefers arranging the individual recesses and/or elevations in a regular, geometric manner, especially on grounds of manufacture. In the light of an illustrative embodiment of the latter case, it is proposed to arrange the individual recesses and/or elevations in several mutually perpendicular rows and at equal spacings from one another.

An illustrative embodiment especially preferred because of an especially simple and economical manufacture of the pertinent bottom of the turbulence chamber is characterized in that the individual recesses and/or elevations can be machined by working the turbulence chamber bottom perpendicularly to its surface by using an end miller.

In a further development of the basic concept of the invention, it is proposed to make the recesses and/or elevations in the shape of polyhedrons, preferably in the shape of blocks or pyramidal, or truncated pyramids. A prismatic design of the individual recesses or elevations also is conceivable. With respect to manufacture by milling which is as simple and economical as possible, however, mainly the geometric shapes of the recesses or elevations of the inventions cited above as preferred will be desired.

However when the bottom of the turbulence chamber is made of a plastic injection molded part, the recesses and/or elevations also may be made conical or as truncated cones, with the individual cones possible evincing each a circular, kidney-shaped, elliptical or oval cross-section. Again a rectangular shape with rounded off corners is conceivable when making the elevations or recesses by the plastic injection molding method.

To control the flow conditions as needed, or to make possible exchanging any clogged turbulence chamber bottoms, the invention in a further advantageous development proposes to connect the turbulence chamber bottom in detachable manner with the nozzle housing forming the turbulence chamber. A relevant illustrative embodiment of the invention is characterized by a panel-like component forming the turbulence bottom and which can be detachably mounted by a fastening flange to the rear end face of the nozzle housing.

In a further embodiment of the invention, it is proposed that the distance (A) of the liquid feed bore(s) issuing tangentially into the turbulence chamber from the point of the part forming the turbulence chamber bottom nearest to the feed bore be about one tenth of the diameter of the liquid feed bore(s) measured in the axial direction of the turbulence chamber. This ensures an optimal control of the liquid flowing into the turbulence chamber by means of the irregular design of the invention of the turbulence chamber bottom. If the distance were larger, the liquid inflow rate would be inadequate, and if the distance were less, the control would be too tight.

Further details and advantages of the invention are listed in the dependent claims and can be better understood by means of an illustrative embodiment shown in the drawing and discussed below.

Figure 2:
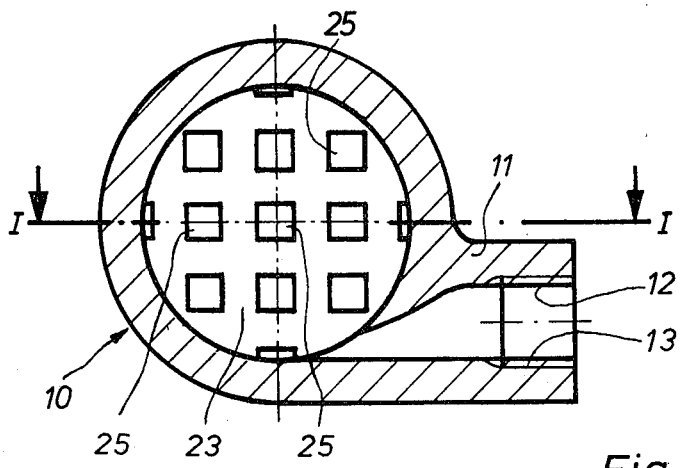
FIG. 2 is a section along line II—II of FIG. 1.
Figure 1:
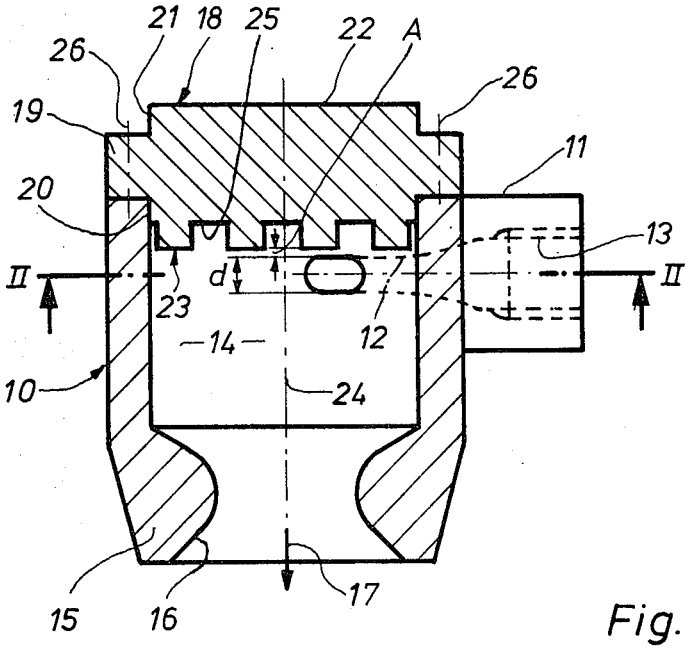
FIG. 1 is a solid-cone jet nozzle in vertical longitudinal section (section I—I of FIG. 2)

Referring to FIGS. 1 and 2, the housing of the shown solid-cone jet nozzle is denoted by 10. The housing 10 comprises a sideways integrated liquid feed means 11 with an inwardly constricting liquid feed bore 12. A thread 13 is used to connect to a liquid supply line (not shown). A turbulence chamber 14 is arranged inside the housing 10 and into this chamber issues the liquid supply bore 12 in a tangential manner. At the lower end of nozzle design shown in FIG. 1, a nozzle mouth piece denoted by 15 is formed, which constricts conically and adjoiningly forms a flaring nozzle discharge 16. Thus the liquid flowing tangentially into the nozzle housing 10 at 11 is set therein into rotation and deflected by 90° and finally exists as a solid-cone jet from the nozzle discharge 16 in the direction of the arrow 17.

FIG. 1 further shows that the nozzle housing 10 is sealed at its rear end by a disk-like part denoted as a whole by 18. The disk-like part 18 is offset on both sides, the offsets forming a fastening flange 19. The offsets moreover form on both sides of the disk-like part 18 cylindrical surfaces 20, 21 of which the diameter corresponds to the inside diameter of the turbulence chamber 14, whereby the cylindrical surfaces 20, 21 act to center the disk-like part 18 in the nozzle housing 10. The disk-like part 18 comprises two end faces 22 and 23 either of which can form the rear end side seal (turbulence chamber bottom) of the turbulence chamber 14. In the embodiment shown in the drawing, it is the end face 23 of the disk-like part 18 which acts as the turbulence chamber bottom. The turbulence chamber bottom 23 is made plane as a whole and extends perpendicularly to the longitudinal axis 24 of the nozzle. It is provided however with several individual recesses 25 arranged in several mutually perpendicular rows and at equal spacings from one another. The recesses 25 are essentially the same with respect to one another and in the embodiment shown evince block shapes. However other shapes of the recesses 25 are conceivable. Conceivably too, there may be individual elevations on the bottom of the turbulence chamber in lieu of the recesses 25. Again it is possible to arrange both individual recesses and elevations on the turbulence chamber bottom.

As shown by FIG. 1, the distance denoted by A between the liquid feed bore 12 entering the turbulence chamber 14 and the turbulence chamber bottom 23 is about one tenth of the inlet diameter d of the liquid feed bore 12. Because of this arrangement of the liquid feed bore 12 and the turbulence chamber bottom 23, the individual recesses 25 act optimally on the desired formation of a solid-cone jet.

The other end face 22 of the disk-like part 18, already mentioned above, on the other hand is made wholly plane, i.e. it evinces no elevations or recesses at all. If now this end face 22 is selectively used as the turbulence chamber bottom, then selectively a hollow cone jet can be obtained from the same nozzle. Suitable fastening screws, such as are indicated by the dot-dashed lines 26, can be detachably mounting the disk-like part 18 which is exchangeable or rotatable in the manner already described.

Figure 4:
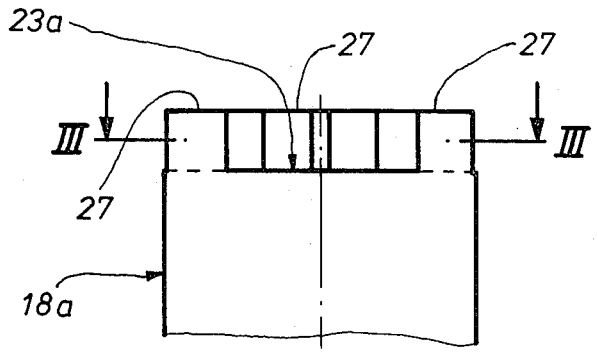
FIG. 4 is the object of FIG. 3 shown in side view.
Figure 3:
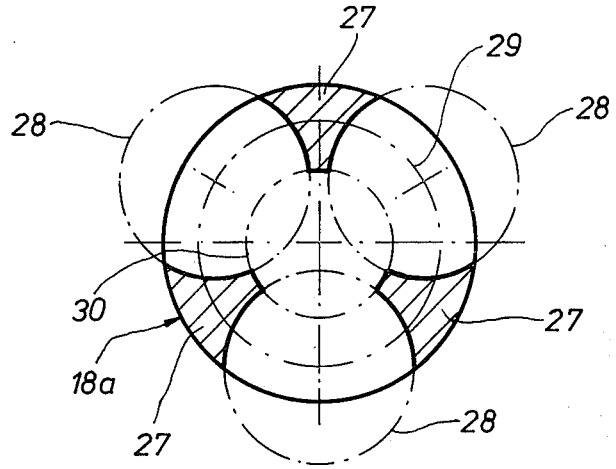
FIG. 3 is another embodiment of a turbulence chamber bottom shown in section along line III—III of FIG. 4.
Figure 5:
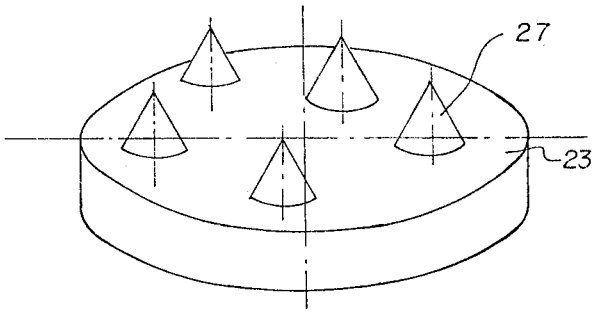
FIG. 5 is a perspective view of another embodiment of a turbulence chamber bottom.
Figure 6:
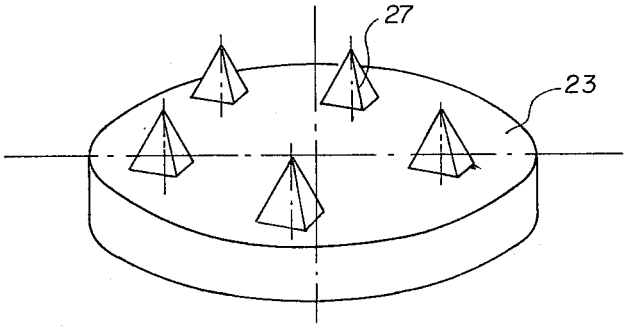
FIG. 6 is a perspective view of yet another turbulence bottom.

As regards the embodiment of FIGS. 3 and 4, a cylindrical component **18*a* forms the turbulence chamber bottom 23*a*. In the example shown, a total of three elevations are provided; they are made by milling with end millers. The milling positions required to that end are indicated by the dot-dash lines and denoted by 28. FIG. 3 clearly shows that the three millings 28 are located on a common pitch-circle 29 and that they are circumferentially 120° apart from each other. A fourth milling is provided moreover in the embodiment shown in FIGS. 3 and 4 (dash-dot circle 30) by means of which material connections previously still existing between the individual elevations 27** are removed.

It must be emphasized however that the invention in no way is meant to be restricted to the representation shown in FIGS. 3 and 4. In practice more than three millings are provided in the circumferential direction as shown in FIG. 3, in order to generate a larger number of elevations or recesses. Moreover the millings basically need not lie on a common pitch-circle (29) nor are they absolutely required to be equally spaced apart in the circumferential direction. Again the diameter of common pitch-circle (29)—if such is selected—need not absolutely be less than the diameter of the turbulence chamber bottom **23*a*; it also may be larger or of the same size. In many cases it is not mandatory that in addition to the millings (28) located in the circumferential direction there also be a central milling (30). Thus it is wholly conceivable that the material bridges be allowed to remain at the center of the turbulence chamber bottom and to generate in this manner recesses (28**) which are separate from one another.

However there are many manufacturing advantages by machining the turbulence chamber bottom **23*a* so as to obtain millings of the same diameter and located on a common pitch-circle (29**) at equal angular spacings, compared to a possible geometrically irregular machining, in particular if the machining is performed on a circular table milling unit (synchronized machining).

We claim:

1. A solid-cone jet nozzle, comprising:

a. an open ended cylindrical housing having a central longitudinal axis and including a turbulence chamber therein;
b. said chamber having an inner annular wall;
c. inlet means for said chamber, said inlet means substantially tangential to said chamber;
d. a turbulence chamber bottom spaced from said inlet means and closing one end of said housing and having a number of sized shaped spaced elevations axially extending therefrom into said chamber, at least a portion of said number spaced from said inner annular wall; and,
e. flaring nozzle means co-axially positioned on said housing opposite said bottom whereby fluid entering said chamber is rotationally oriented and interacts with said elevations to exit said nozzle with a solid-cone pattern having a substantially axial orientation.

2. A solid-cone jet nozzle, comprising:
a. an open ended cylindrical housing having a central longitudinal axis and including a turbulence chamber therein;
b. said chamber having an inner annular wall;
c. inlet means for said chamber, said inlet means substantially tangential to said chamber;
d. a turbulence chamber bottom spaced from said inlet means and closing one end of said housing;
e. a number of elevations associated with said bottom and axially extending therefrom into said chamber, said elevations having substantially arcuate axially extending external side surfaces only and said elevations tapering from said inner annular wall toward said central axis; and,
f. flaring nozzle means co-axially positioned on said housing opposite said bottom whereby fluid entering said chamber is rotationally oriented and interacts with said elevations to exit said nozzle with a solid-cone pattern having a substantially axial orientation.

3. A solid-cone jet nozzle as described in claim 1, wherein:
a. said elevations are arranged in a number of spaced rows.

4. A solid-cone jet nozzle as described in claim 1, wherein:
a. said elevations are arranged in a regular geometric array.

5. A solid-cone jet nozzle as described in claim 1, wherein:
a. said elevations include substantially rectangular polyhedrons.

6. A solid-cone jet nozzle as described in claim 1, wherein:
a. said elevations include substantially pyramidal shaped structures.

7. A solid-cone jet nozzle as described in claim 1, wherein:
a. said elevations include substantially conically shaped structures.

8. A solid-cone jet nozzle as described in claim 2, wherein:
a. said elevations define a number of partially circular chambers located between adjacent elevations;
b. said circular chambers are positioned equi-angularly around said bottom; and,
c. each of said substantially circular chambers has a central axis and each of said central axes is positioned an equal distance from said chamber axis.

9. A solid-cone jet nozzle as described in claim 8, wherein:
a. each of said central axes is positioned a distance from said chamber axis which does not exceed said bottom radius.

10. A solid-cone jet nozzles described in claim 8, wherein:
a. a substantially circular chamber co-axial with said bottom is centrally positioned between said elevations.

11. A solid-cone jet nozzle as described in claim 1 or 2, wherein:
a. said bottom is detachably mounted to said housing.

12. A solid-cone jet nozzle as described in claim 11, wherein:
a. said bottom includes a radially extending flange for detachably fastening said bottom to said housing.

13. A solid-cone jet nozzle as described in claim 11, wherein:
a. said bottom includes an upper surface and a lower surface;
b. said elevations are associated with said lower surface; and,
c. either of said surfaces may be positioned so as to be adjacent said housing whereby one of said surfaces is therefore not adjacent said housing.

14. A solid-cone jet nozzle as described in claim 12, wherein:
a. said flange is positioned between an upper surface and a lower surface of said bottom;
b. said flange diameter at least equals said housing diameter; and,
c. said upper surface and said lower surface have equal diameters and said diameters are less than said turbulence chamber diameter whereby one of said surfaces may be positioned in said chamber for centering said flange on said housing.

15. A solid-cone jet nozzle as described in claim 13, wherein:
a. said upper surface is substantially flat; and,
b. positioning of said upper surface adjacent said housing produces a hollow cone pattern.

16. A solid-cone jet nozzle as described in claim 1 or 2, wherein:
a. said bottom is spaced a distance from said inlet means; and,
b. said distance is substantially equal to one-tenth said inlet means diameter.

* * * * *